US005846052A

United States Patent [19]

Kameda

[11] Patent Number: 5,846,052

[45] **Date of Patent: *Dec. 8, 1998**

[54] HIGH-PRESSURE MULTISTAGE PUMP

[75] Inventor: Shinichirou Kameda, Kawasaki, Japan

[73] Assignee: Ebara Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 710,929

[22] Filed: Sep. 24, 1996

[30] Foreign Application Priority Data

Sep. 26, 1995 [JP] Japan ..... 7-247328

[51] Int. Cl.[6] ..... F04D 29/42

[52] U.S. Cl. ..... 415/182.1

[58] Field of Search ..... 415/182.1, 214.1, 415/170.1

[56] References Cited

U.S. PATENT DOCUMENTS

| | | | |
|---|---|---|---|
| 2,058,017 | 10/1936 | Hollander | 415/214.1 |
| 2,678,606 | 5/1954 | Watson | 103/108 |
| 3,801,217 | 4/1974 | Ryall et al. | 415/214.1 |
| 3,861,825 | 1/1975 | Blom | 415/198 |
| 4,715,778 | 12/1987 | Katayama et al. | 415/182.1 |
| 5,452,987 | 9/1995 | Bleger et al. | 415/214.1 |

FOREIGN PATENT DOCUMENTS

| | | |
|---|---|---|
| 610876 | 9/1926 | France . |
| 56-41482 | 4/1981 | Japan . |

OTHER PUBLICATIONS

Nobuyasu Yokoi et al.; "Development of Advanced Type Boiler Feedwater Pump"; The Hitachi Hyoron; vol. 62, No. 6; pp. 63–65; 1980.

Dr. Dusan Florjancic et al.; "Injection Pumps: State of the Art and Development Trends"; *Sulzer Technical Review*; Feb. 1989; pp. 19–26.

*Primary Examiner*—John T. Kwon

*Attorney, Agent, or Firm*—Armstrong, Westerman, Hattori, McLeland & Naughton

[57] ABSTRACT

A high-pressure multistage pump is used for supplying liquid to facilities such as boilers under a high discharge pressure. The high-pressure multistage pump has a barrel-shaped outer casing, an inner casing housed in the barrel-shaped outer casing, a cover sealingly closing an axial end of the outer casing, a pump shaft rotatably supported in the inner casing and the cover, and an array of impellers mounted on the pump shaft. One of the impellers has a suction chamber positioned most closely to the cover and held in communication with an inner space which is jointly defined by the outer casing, the inner casing and the cover.

4 Claims, 7 Drawing Sheets

HIGH-PRESSURE MULTISTAGE PUMP

BACKGROUND OF THE INVENTION

1. Field of the Invention

The present invention relates to a high-pressure multistage pump having an inner casing which comprises upper and lower casing members, a barrel-shaped outer casing which houses the inner casing, and a cover which sealingly closes an axial open end of the outer casing.

2. Description of the Prior Art

High-pressure multistage pumps have heretofore been used as boiler feed pumps for supplying water to boilers under a discharge pressure ranging from 300 to 500 kg/cm$^2$. It is expected that the high-pressure multistage pumps will be used in applications for higher discharge pressures.

FIG. 7 of the accompanying drawings shows a conventional high-pressure four-stage pump. As shown in FIG. 7, a conventional high-pressure four-stage pump has a barrel-shaped outer casing 1 and an inner casing 2A housed in the barrel-shaped outer casing 1. The inner casing 2A comprises upper and lower casing members. The outer casing 1 has an axial open end covered with a cover 3C.

The inner casing 2A accommodates an axial array of impellers 21*a*–21*d* mounted on a rotatable pump shaft 20 which axially extends through the inner casing 2A and the cover 3C. The pump shaft 20 has an end rotatably supported by a radial bearing 24 on a bracket 22 which is attached to an end of the inner casing 2A remote from the cover 3C. A mechanical seal 25 is interposed between the inner casing 2A and the pump shaft 20.

The other end of the pump shaft 20 is rotatably supported by a radial bearing 24 on a bracket 23 attached to the cover 3C. A thrust bearing 26 is provided on the bracket 23 to receive thrust forces applied to the pump shaft 20. A mechanical seal 25 is interposed between the cover 3C and the pump shaft 20.

The impellers 21*a*, 21*b* provide first and second stages a, b, respectively, which define a low-pressure region A in the inner casing 2A, and the impellers 21*c*, 21*d* provide third and fourth stages c, d, respectively, which define a high-pressure region B in the inner casing 2A. The impellers 21*a*, 21*b* in the low-pressure region A and the impellers 21*c*, 21*d* in the high-pressure region B are positioned in back-to-back relation in the inner casing 2A. The impellers 21*a*, 21*b* have respective suction mouths, which are open axially outwardly, and the impellers 21*c*, 21*d* have respective suction mouths which are open axially outwardly. A liquid which is introduced into the inner casing 2A through an inlet chamber 17 defined in the inner casing 2 is pressurized successively through the first through fourth stages a–d by the impellers 21*a*–21*d*, and then discharged under a high discharge pressure from the inner casing 2A through an outlet port 17A.

In the conventional high-pressure four-stage pump shown in FIG. 7, an inner space 10 which is defined by the outer casing 1, the inner casing 2A and the cover 3C communicates with the outlet port 17A, and is filled with the liquid having the high discharge pressure. In order to confine the liquid having the high discharge pressure within the inner space 10, the cover 3C needs to be thick enough to withstand the high discharge pressure. It is difficult to effectively seal the high discharge pressure in the inner space 10 by a gasket 5 interposed between the outer casing 1 and the cover 3C. Since large forces are required to tighten the gasket 5 in place, cover bolts 6A used to fasten the cover 3C are relatively large in diameter (see Japanese patent publication No. 56-41482, for example).

Japanese patent publication No. 63-3160 discloses the use of shear keys instead of cover bolts for allowing a high-pressure multistage pump to be assembled and disassembled with ease, and also reveals the use of a cartridge structure for facilitating internal elements. The shear keys require a gasket which does not need to be tightened. In applications such as boiler feed pumps which experience frequent thermal or pressure cycles and seal surface deformations, however, the gasket cannot maintain stable sealing performance, and the shear keys often fail to operate as intended.

SUMMARY OF THE INVENTION

It is therefore an object of the present invention to provide a high-pressure multistage pump which develops a reduced internal pressure imposed on a cover attached to an outer casing.

According to the present invention, there is provided a high-pressure multistage pump comprising a barrel-shaped outer casing having an outlet port, an inner casing housed in the barrel-shaped outer casing, a cover sealingly closing an axial end of the outer casing, a pump shaft rotatably supported in the inner casing and the cover, and an array of impellers mounted on the pump shaft, one of the impellers having a suction chamber positioned most closely to the cover, wherein the outer casing, the inner casing and the cover jointly define an inner space held in communication with the suction chamber.

The array of the impellers is divided into two groups in a low-pressure region and a high-pressure region, the one of impellers has the suction chamber developing a lowermost pressure in the high-pressure region.

The high-pressure multistage pump further comprises a lip gasket interposed between the outer casing and the inner casing and providing a seal between the outlet port and the inner space.

The high-pressure multistage pump further comprises shear keys by which the cover is attached to the outer casing, and a lip gasket interposed between the outer casing and the cover. The inner casing has an inlet chamber through which a liquid is introduced into said inner casing, an O-ring is disposed axially outwardly of the lip gasket, and a space is defined between the lip gasket and the O-ring and held in communication with the inlet chamber.

The above and other objects, features, and advantages of the present invention will become apparent from the following description when taken in conjunction with the accompanying drawings which illustrate preferred embodiments of the present invention by way of example..

DETAILED DESCRIPTION OF THE PREFERRED EMBODIMENTS

Figure 1:
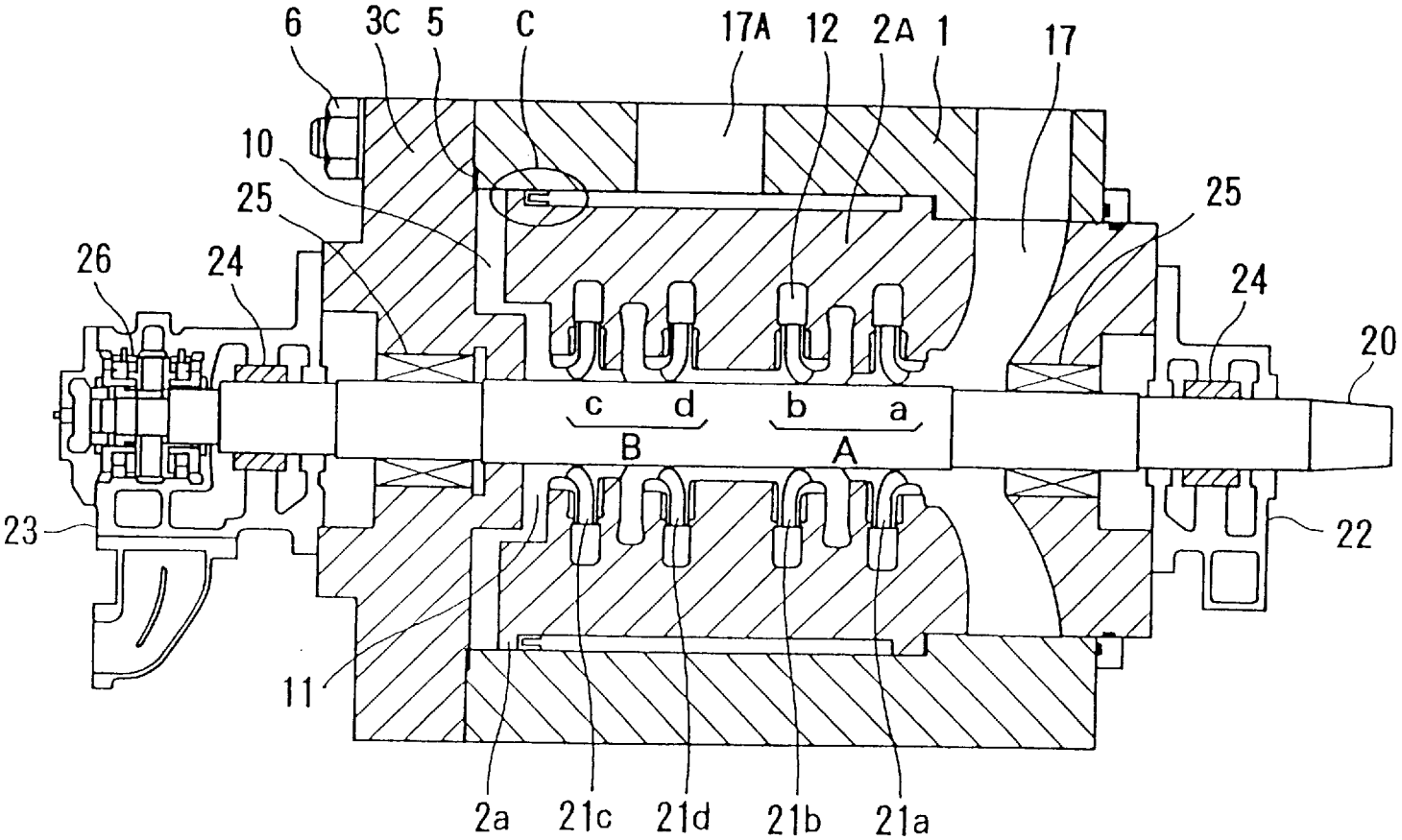
FIG. 1 is an axial cross-sectional view of a high-pressure four-stage pump according to a first embodiment of the present invention.

Like or corresponding parts are denoted by like or corresponding reference numerals throughout views.

FIG. 1 shows a high-pressure four-stage pump according to a first embodiment of the present invention. As shown FIG. 1, the high-pressure four-stage pump has a barrel-shaped outer casing 1 and an inner casing 2A housed in the barrel-shaped outer casing 1. The inner casing 2A comprises upper and lower casing members. The outer casing 1 has an axial open end covered with a cover 3C.

The inner casing 2A accommodates an axial array of impellers 21*a*–21*d* mounted on a rotatable pump shaft 20 which axially extends through the inner casing 2A and the cover 3C. The pump shaft 20 has an end rotatably supported by a radial bearing 24 on a bracket 22 which is attached to an end of the inner casing 2A remote from the cover 3C. A mechanical seal 25 is interposed between the inner casing 2A and the pump shaft 20.

The other end of the pump shaft 20 is rotatably supported by a radial bearing 24 on a bracket 23 attached to the cover 3C. A thrust bearing 26 is provided on the bracket 23 to receive thrust forces applied to the pump shaft 20. A mechanical seal 25 is interposed between the cover 3C and the pump shaft 20.

The impellers 21*a*, 21*b* provide first and second stages a, b, respectively, which define a low-pressure region A in the inner casing 2A, and the impellers 21*c*, 21*d* provide third and fourth stages c, d, respectively, which define a high-pressure region B in the inner casing 2A. The impellers 21*a*, 21*b* in the low-pressure region A and the impellers 21*c*, 21*d* in the high-pressure region B are positioned in back-to-back relation in the inner casing 2A. The impellers 21*a*, 21*b* have respective suction mouths, which are open axially outwardly, and the impellers 21*c*, 21*d* have respective suction mouths which are open axially outwardly. A liquid which is introduced into the inner casing 2A through an inlet chamber 17 defined in the inner casing 2 is pressurized successively through the first through fourth stages a–d by the impellers 21*a*–21*d*, and then discharged under a high discharge pressure from the inner casing 2A through an outlet port 17A.

Figure 2:
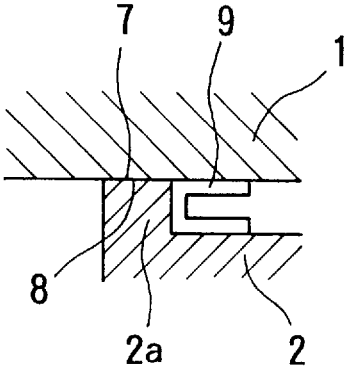
FIG. 2 is an enlarged fragmentary cross-sectional view of an encircled portion C of the high-pressure four-stage pump shown in FIG. 1.

FIG. 2 is an enlarged fragmentary cross-sectional view of an encircled portion C in FIG. 1.

As shown in FIG. 2, the inner casing 2 has a radial flange 2*a* on an end thereof which faces a cover 3 fastened to the outer casing 1 by cover bolts 6. The cover 3 sealingly closes an axial open end of the outer casing 1. The radial flange 2*a* has a radially outer surface 7 held against an inner circumferential surface of the outer casing 1. A lip gasket 9 is fitted between the inner circumferential surface of the outer casing 1 and an outer circumferential surface of the inner casing 2, and held against an axial end surface of the radial flange 2*a*. The lip gasket 9 serves to seal the contacting surfaces of the radial flange 2*a* and the outer casing 1, thereby providing a seal between the outlet port 17A and an inner space 10.

The inner space 10 is defined by the outer casing 1, the inner casing 2 and the cover 3, and communicates with a suction chamber 11 of the impeller 21*c* which is positioned most closely to the cover 3. A pressure which is developed in the inner space 10 is the same as the suction pressure of the impeller 21*c*. As well known in the art, the suction chamber 11 communicates with a discharge chamber 12 of the impeller 21*b* which is positioned in a portion of the low-pressure region A that is closer to the center of the inner casing 2, through an inner passage (not shown) defined in the inner casing 2. Therefore, the inner space 10 has a pressure which is the same as the discharge pressure in the discharge chamber 12.

The discharge pressure Pf in the discharge chamber 12 is expressed as follows:

$$Pf=2P+Ps$$

where P is the pressure developed each of the first through fourth stages a–d, and Ps is the suction pressure of the pump. If the suction pressure Ps of the pump is much smaller than the total pressure, then the discharge pressure Pf is substantially equal to 2P which is expressed by:

$$2P=Pd/2$$

where Pd is the discharge pressure of the pump (which is substantially equal to 4P). Therefore, the internal pressure acting on the cover 3 is about half the discharge pressure Pd of the pump.

If the high-pressure four-stage pump has an odd number of impellers, rather than an even number of impellers as shown in FIG. 1, then the discharge pressure Pf in the discharge chamber 12 differs depending on whether an extra impeller produced when the odd number of impellers are divided into two groups in the respective low- and high-pressure regions A, B is added to the low-pressure region A or the high-pressure region B. In any case, however, the internal pressure acting on the cover 3 is much smaller than the discharge pressure Pd of the pump.

Figure 7:
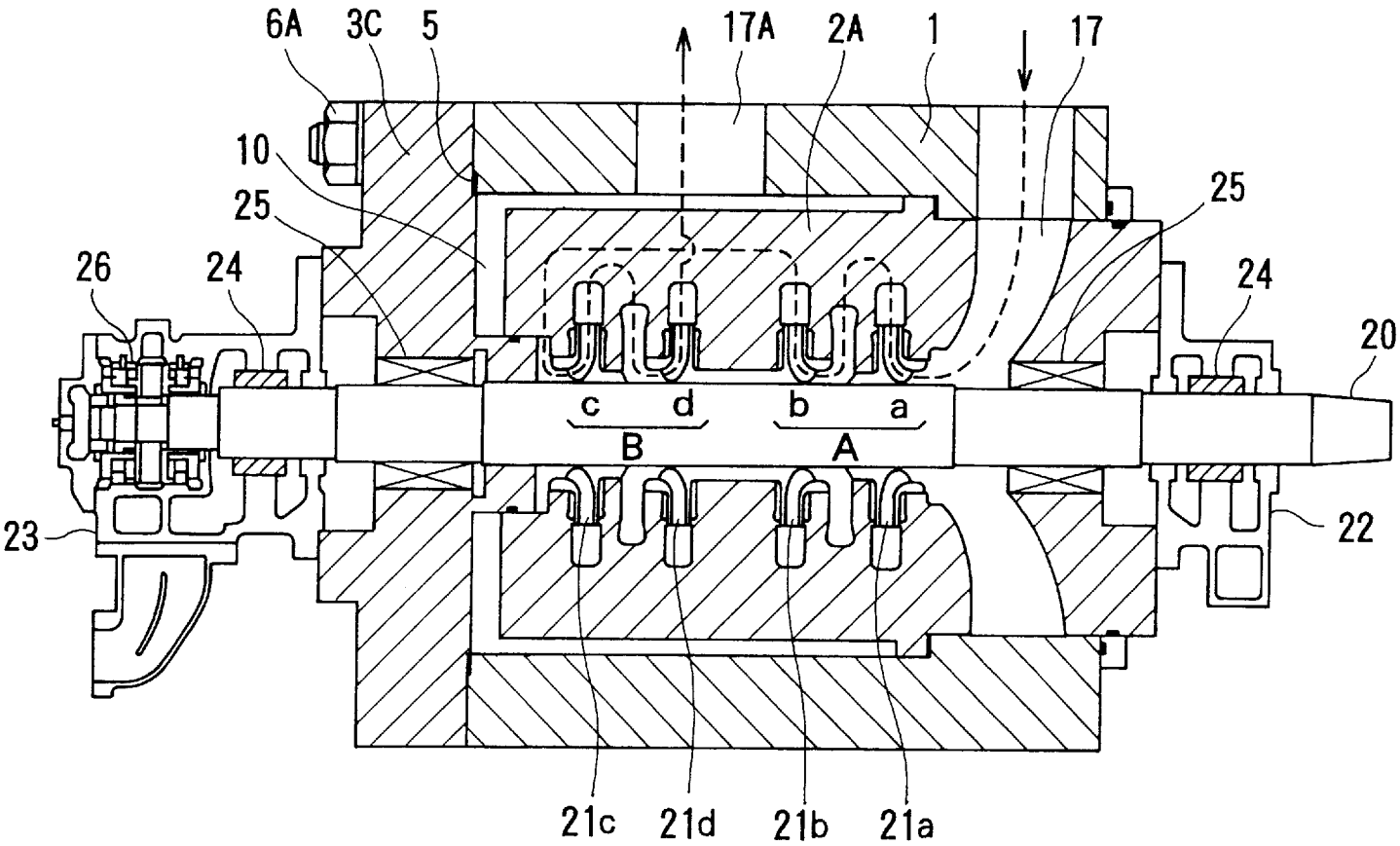
FIG. 7 PRIOR ART
FIG. 7 is an axial cross-sectional view of a conventional high-pressure four-stage pump.

Therefore, the thickness of the cover 3 and the forces required to fasten the cover bolts 6, and hence the number and size of the cover bolts, are smaller than those of the conventional high-pressure multistage pump in which the discharge pressure directly acts on the cover 3C (see FIG. 7). Furthermore, the pressure applied to the gasket 5 between the outer casing 1 and the cover 3 is lower, thus increasing the reliability of the gasket 5.

Figure 3:
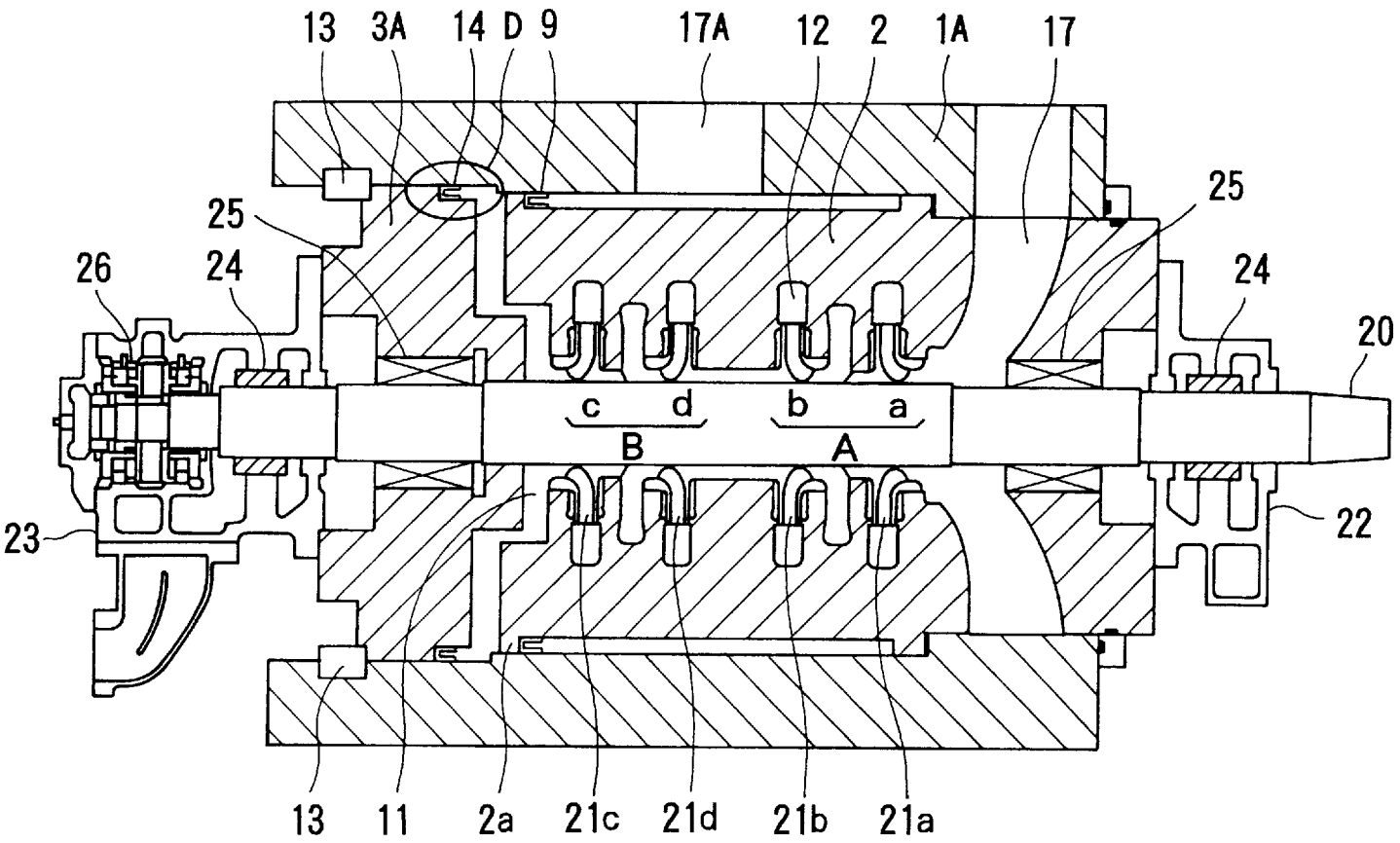
FIG. 3 is an axial cross-sectional view of a high-pressure four-stage pump according to a second embodiment of the present invention.

FIG. 3 shows a high-pressure multistage pump according to a second embodiment of the present invention. The high-pressure multistage pump according to the second embodiment is essentially the same as the high-pressure multistage pump according to the first embodiment except that shear keys 13, rather than the cover bolts 6, are used to fasten a cover 3A to an outer casing 1A. Specifically, the cover 3A is fitted in the outer casing 1A, and the shear keys 13, each in the form of a segment of an annular shape, are then fitted in the outer casing 1A to hold the cover 3A in place.

Figure 4:
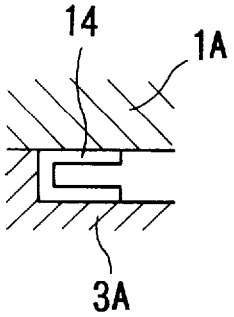
FIG. 4 is an enlarged fragmentary cross-sectional view of an encircled portion D of the high-pressure four-stage pump shown in FIG. 3.

FIG. 4 is an enlarged fragmentary cross-sectional view of an encircled portion D in FIG. 3. Since the shear keys 13 do not produce gasket tightening forces, as shown in FIG. 4, a lip gasket 14 which does not need to be tightened is positioned to provide a seal between the outer casing 1A and the cover 3A.

The internal pressure acting on the cover 3A is about half the discharge pressure of the pump. In high-pressure boiler feed pumps which are started and stopped once a day and hence experience frequent thermal and pressure variations, any shear keys used therein are required to be considerably large in size and hence are not practical, in view of safety margins required for the design strength and fatigue life. According to the second embodiment, since the internal pressure acting on the cover 3A is about half the discharge pressure of the pump, the shear keys 13 which support the cover 3A against the internal pressure may be reduced in size, and can be incorporated in high-pressure boiler feed pumps.

Figure 5:
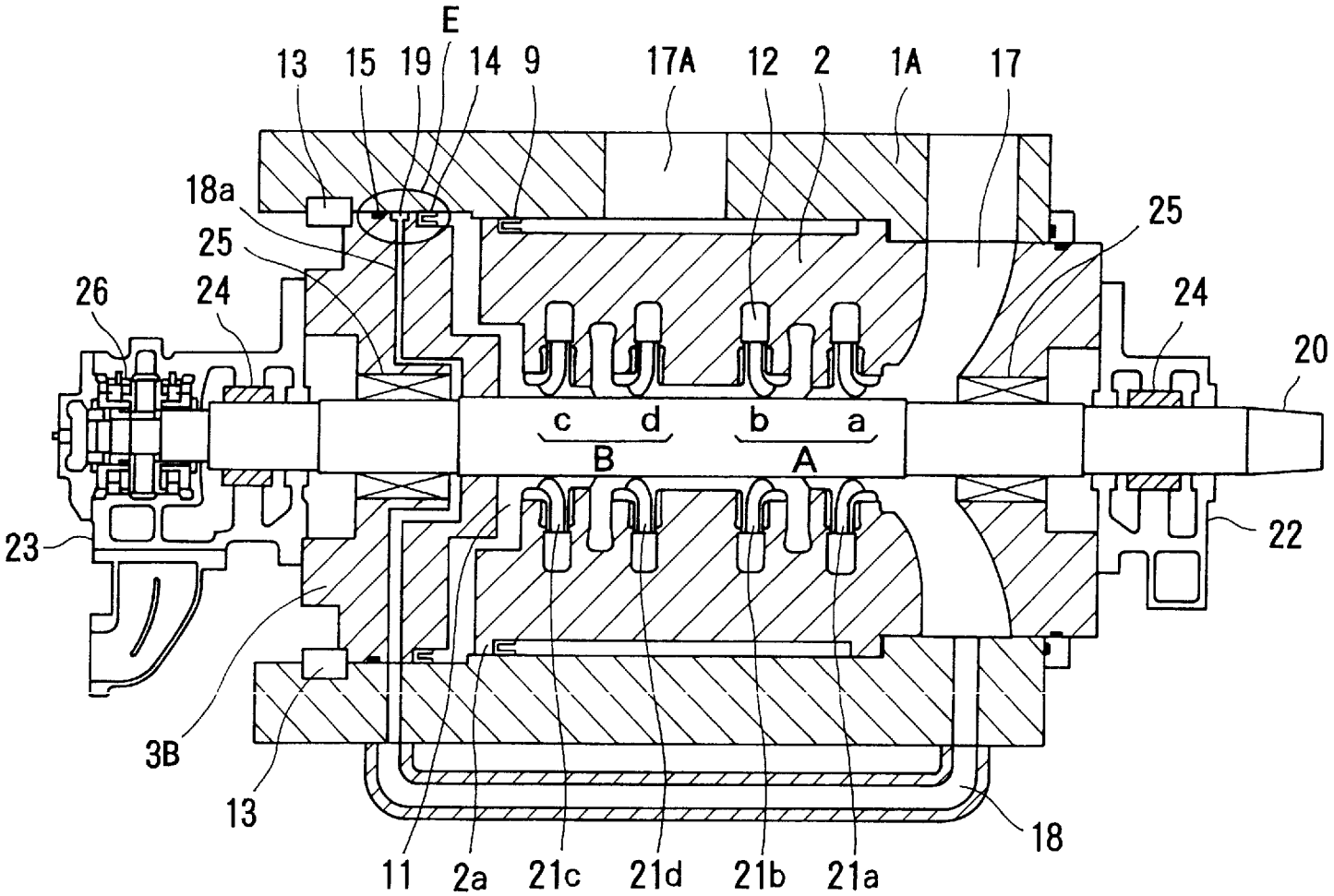
FIG. 5 is an axial cross-sectional view of a high-pressure four-stage pump according to a third embodiment of the present invention.
Figure 6:
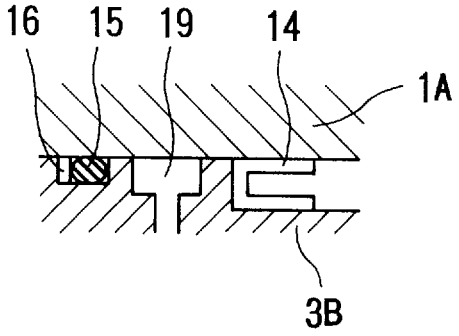
FIG. 6 is an enlarged fragmentary cross-sectional view of an encircled portion E of the high-pressure four-stage pump shown in FIG. 5.

FIG. 5 shows a high-pressure multistage pump according to a third embodiment of the present invention. FIG. 6 is an enlarged fragmentary cross-sectional view of an encircled portion E in FIG. 5. In this embodiment, as shown in FIG. 6, an O-ring 15 and a backup ring 16 are disposed in a cover 3B axially outwardly of the lip gasket 14. An annular groove 19 is defined in the cover 3B axially between the lip gasket 14 and the O-ring 15 and held in communication with the inlet chamber 17 through a passage 18*a* defined in the cover 3B and a pipe 18 mounted on the outer casing 1A. If the liquid leaks from the suction chamber 11 through the lip gasket 14, it enters the annular groove 19 and returns through the passage 18*a* and the pipe 18 back to the inlet chamber 17. Inasmuch as a suction pressure is developed in the annular groove 19, the suction pressure is applied to the O-ring 15, thus making it easy for the O-ring 15 to provide an effective seal between the outer casing 1A and the cover 3B. Generally, there is a possibility that lip gaskets fail to completely stop leaks in devices in high-temperature and high-pressure environments, such as boiler feed pumps. However, the structure according to the third embodiment is effective to increase the safety of the high-pressure multistage pump against leaks through the lip gasket 14.

While the lip gaskets are shown as being incorporated in high-pressure multistage pumps according to the illustrated embodiments, other seal members such as V-shaped gaskets may be used in normal-temperature applications such as a descaling pump or the like.

As is apparent from the above description, the present invention offers the following advantages:

Since the internal pressure applied to the cover is reduced, the thickness of the cover can be small and the size of the cover bolts can be small.

Further, application range in the high-pressure multistage pumps can be expanded by the use of the shear keys.

Leaking of the liquid from the pump to the external through the seal portion can be prevented, and the pump can be assembled and disassembled with ease. Assembling cost and material cost of the pump can be reduced greatly.

Although certain preferred embodiments of the present invention have been shown and described in detail, it should be understood that various changes and modifications may be made therein without departing from the scope of the appended claims.

What is claimed is:

1. A high-pressure multistage pump comprising:

a barrel-shaped outer casing having an outlet port;

an inner casing housed in said barrel-shaped outer casing;

a cover closing an axial end of said outer casing;

a pump shaft rotatably supported in said inner casing and said cover; and an array of impellers mounted on said pump shaft, one of said impellers having a suction chamber positioned in said inner casing most closely to said cover;

wherein said outer casing, said inner casing and said cover jointly define an inner space in communication with said suction chamber, and said outer casing and said inner casing define an outer space in communication with said outlet port, and a pressure developed in said inner space is about half a pressure developed in said outer space when said multistage pump is in high-pressure operation, and a lip gasket is interposed between said outer casing and said inner casing to form a seal between said outer space and said inner space for preventing high pressure flow from said outer casing into said inner casing.

2. A high-pressure multistage pump according to claim 1, wherein said array of said impellers is divided into two groups in a low-pressure region and a high-pressure region, said one of impellers has said suction chamber developing a lowermost pressure in said high-pressure region.

3. A high-pressure multistage pump according to claim 1, further comprising shear keys by which said cover is attached to said outer casing, and a lip gasket interposed between said outer casing and said cover.

4. A high-pressure multistage pump according to claim 3, wherein said inner casing has an inlet chamber through which a liquid is introduced into said inner casing, and further comprising an O-ring disposed axially outwardly of said lip gasket, a space being defined between said lip gasket and said O-ring and held in communication with said inlet chamber.

* * * * *